US009316978B2

(12) United States Patent
Suzuki et al.

(10) Patent No.: US 9,316,978 B2
(45) Date of Patent: Apr. 19, 2016

(54) FIXING DEVICE, IMAGE FORMING APPARATUS, AND FIXING METHOD

(71) Applicants: Naoto Suzuki, Kanagawa (JP); Takashi Sakamaki, Kanagawa (JP)

(72) Inventors: Naoto Suzuki, Kanagawa (JP); Takashi Sakamaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/742,292

(22) Filed: Jun. 17, 2015

(65) Prior Publication Data

US 2016/0004199 A1 Jan. 7, 2016

(30) Foreign Application Priority Data

Jul. 2, 2014 (JP) ..... 2014-137080

(51) Int. Cl.
*G03G 15/20* (2006.01)

(52) U.S. Cl.
CPC ..... *G03G 15/2075* (2013.01)

(58) Field of Classification Search
CPC ..... G03G 15/2096; G03G 15/2075
USPC ..... 399/324, 325, 327, 340
See application file for complete search history.

(56) References Cited

U.S. PATENT DOCUMENTS 5,221,948 A * 6/1993 Dalal ..... G03G 15/2025 399/325
5,436,711 A * 7/1995 Hauser ..... G03G 15/2064 399/324
2004/0101333 A1* 5/2004 Wu ..... G03G 15/2025 399/325
2005/0185978 A1* 8/2005 Kemmochi ..... G03G 15/2017 399/69
2007/0166085 A1* 7/2007 Shinshi ..... G03G 15/2057 399/329
2010/0316397 A1 12/2010 Kudou et al.
2012/0195653 A1* 8/2012 Sasaki ..... G03G 15/20 399/327
2014/0212188 A1 7/2014 Watanabe
2014/0294456 A1 10/2014 Ueno et al.

FOREIGN PATENT DOCUMENTS

JP 08106231 a * 4/1996
JP 11224019 a * 8/1999
JP 2000137402 a * 5/2000
JP 2002318482 A 10/2002

(Continued)

OTHER PUBLICATIONS

Ishino et al., "Cleaning Device for Oil Applying Means", Aug. 1999, JP11-224019, machine English translations of Detailed Description by JPO.*

*Primary Examiner* — Susan Lee
(74) *Attorney, Agent, or Firm* — Harness, Dickey & Pierce, P.L.C.

(57) ABSTRACT

A fixing device includes a fixing rotator and a pressure rotator pressed against the fixing rotator to form a fixing nip therebetween. An oil applicator is impregnated with oil to be applied to at least one of the fixing rotator and the pressure rotator. A first mover is connected to the oil applicator to separably bring the oil applicator into contact with the at least one of the fixing rotator and the pressure rotator. A surface polisher refreshes an outer circumferential surface of the fixing rotator. A second mover is connected to the surface polisher to separably bring the surface polisher into contact with the fixing rotator. The first mover brings the oil applicator into contact with the at least one of the fixing rotator and the pressure rotator according to a contact condition under which the surface polisher contacts the fixing rotator.

17 Claims, 5 Drawing Sheets

(56) References Cited

FOREIGN PATENT DOCUMENTS

| | | | | |
|---|---|---|---|---|
| JP | 2006-251722 | A | | 9/2006 |
| JP | 2006259341 | A | | 9/2006 |
| JP | 2006317881 | A | | 11/2006 |
| JP | 2008146070 | A | | 6/2008 |
| JP | 2009237250 | a | * | 10/2009 |
| JP | 2011164132 | A | | 8/2011 |
| JP | 2011175067 | A | | 9/2011 |
| JP | 2011227163 | A | | 11/2011 |
| JP | 2013050662 | A | | 3/2013 |
| JP | 2013167663 | A | | 8/2013 |

* cited by examiner

FIXING DEVICE, IMAGE FORMING APPARATUS, AND FIXING METHOD

CROSS-REFERENCE TO RELATED APPLICATION

This patent application is based on and claims priority pursuant to 35 U.S.C. §119 to Japanese Patent Application No. 2014-137080, filed on Jul. 2, 2014, in the Japanese Patent Office, the entire disclosure of which is hereby incorporated by reference herein.

BACKGROUND

1. Technical Field

Example embodiments generally relate to a fixing device, an image forming apparatus, and a fixing method, and more particularly, to a fixing device for fixing a toner image on a recording medium, an image forming apparatus incorporating the fixing device, and a fixing method performed by the fixing device.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

At least one embodiment provides a novel fixing device that includes a fixing rotator rotatable in a given direction of rotation and a pressure rotator pressed against the fixing rotator to form a fixing nip therebetween, through which a recording medium bearing a toner image is conveyed. An oil applicator is impregnated with oil to be applied to at least one of the fixing rotator and the pressure rotator. A first mover is connected to the oil applicator to separably bring the oil applicator into contact with the at least one of the fixing rotator and the pressure rotator. A surface polisher refreshes an outer circumferential surface of the fixing rotator. A second mover is connected to the surface polisher to separably bring the surface polisher into contact with the fixing rotator. A controller is operatively connected to the first mover and the second mover to control the first mover to bring the oil applicator into contact with the at least one of the fixing rotator and the pressure rotator according to a contact condition under which the surface polisher contacts the fixing rotator.

At least one embodiment provides a novel image forming apparatus that includes an image bearer to bear a toner image and a fixing device, disposed downstream from the image bearer in a recording medium conveyance direction, to fix the toner image on a recording medium. The fixing device includes a fixing rotator rotatable in a given direction of rotation and a pressure rotator pressed against the fixing rotator to form a fixing nip therebetween, through which the recording medium bearing the toner image is conveyed. An oil applicator is impregnated with oil to be applied to at least one of the fixing rotator and the pressure rotator. A first mover is connected to the oil applicator to separably bring the oil applicator into contact with the at least one of the fixing rotator and the pressure rotator. A surface polisher refreshes an outer circumferential surface of the fixing rotator. A second mover is connected to the surface polisher to separably bring the surface polisher into contact with the fixing rotator. A controller is operatively connected to the first mover and the second mover to control the first mover to bring the oil applicator into contact with the at least one of the fixing rotator and the pressure rotator according to a contact condition under which the surface polisher contacts the fixing rotator.

At least one embodiment provides a novel image forming method that includes pressing a surface polisher against a fixing rotator with given pressure, rotating the surface polisher in accordance with rotation of the fixing rotator, separating the surface polisher from the fixing rotator, pressing an oil applicator against at least one of the fixing rotator and a pressure rotator, applying oil to the at least one of the fixing rotator and the pressure rotator, and separating the oil applicator from the at least one of the fixing rotator and the pressure rotator.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
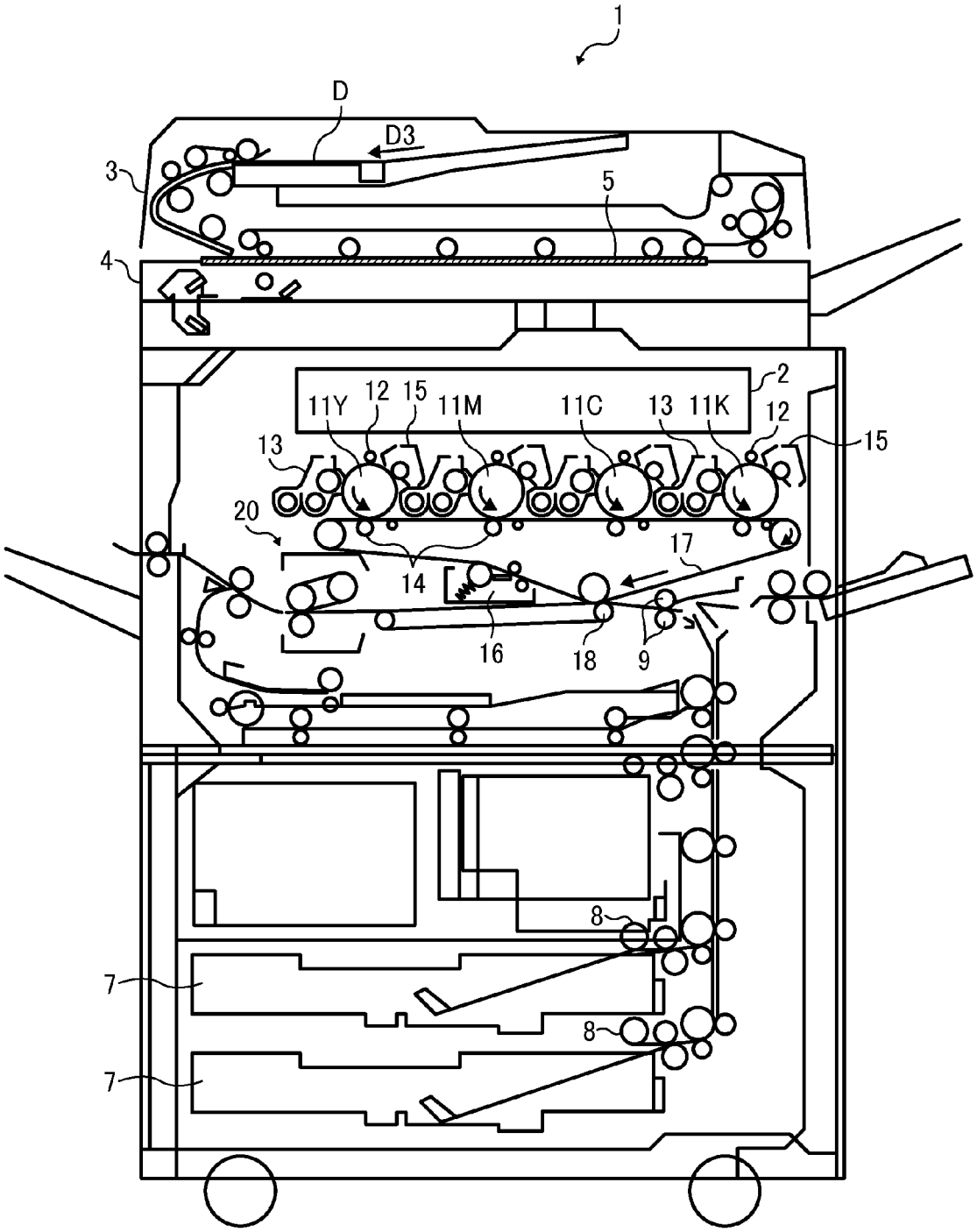
FIG. 1 is a schematic vertical sectional view of an image forming apparatus according to an example embodiment of the present disclosure.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein are interpreted accordingly.

Although the terms first, second, and the like may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to be limiting of the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 1 is a tandem color copier that forms color and monochrome toner images on recording media by electrophotography. Alternatively, the image forming apparatus 1 may be a monochrome copier that forms monochrome toner images.

With reference to FIG. 1, a description is provided of a construction of the image forming apparatus 1.

As shown in FIG. 1, the image forming apparatus 1 includes a writer 2, an auto document feeder (ADF) 3, an original reader 4, a plurality of paper trays 7, a registration roller pair 9, a plurality of photoconductive drums 11Y, 11M, 11C, and 11K, a plurality of chargers 12, a plurality of developing devices 13, a plurality of primary transfer bias rollers 14, a plurality of cleaners 15, and an intermediate transfer belt 17. The ADF 3 feeds an original D to the original reader 4. The original reader 4 reads an image on the original D into image data. The charger 12 charges an outer circumferential surface of the respective photoconductive drums 11Y, 11M, 11C, and 11K. The writer 2 emits a laser beam onto the charged outer circumferential surface of the respective photoconductive drums 11Y, 11M, 11C, and 11K according to the image data to form an electrostatic latent image thereon. The developing device 13 develops the electrostatic latent image formed on the respective photoconductive drums 11Y, 11M, 11C, and 11K into a toner image (e.g., yellow, magenta, cyan, and black toner images). The primary transfer bias rollers 14 primarily transfer the yellow, magenta, cyan, and black toner images formed on the photoconductive drums 11Y, 11M, 11C, and 11K, respectively, onto the intermediate transfer belt 17 such that the yellow, magenta, cyan, and black toner images are superimposed on a same position on the intermediate transfer belt 17 to form a color toner image thereon. Each of the paper trays 7 loads a plurality of recording media (e.g., transfer sheets). The cleaner 15 removes and collects residual toner failed to be transferred onto the intermediate transfer belt 17 and therefore remaining on the respective photoconductive drums 11Y, 11M, 11C, and 11K therefrom. The registration roller pair 9 adjusts a time to convey the recording medium to the intermediate transfer belt 17.

The image forming apparatus 1 further includes an intermediate transfer belt cleaner 16, a secondary transfer bias roller 18, and a fixing device 20. The secondary transfer bias roller 18 secondarily transfers the color toner image formed on the intermediate transfer belt 17 onto the recording medium conveyed by the registration roller pair 9. The intermediate transfer belt cleaner 16 removes residual toner failed to be transferred onto the recording medium and therefore remaining on the intermediate transfer belt 17 therefrom. The fixing device 20 fixes the color toner image on the recording medium.

A description is provided of image forming processes performed by the image forming apparatus 1 to form a color toner image on a recording medium.

A plurality of conveyance rollers of the ADF 3 conveys an original D placed on an original tray in a direction D3 onto an exposure glass 5 of the original reader 4. The original reader 4 optically reads an image on the original D placed on the exposure glass 5. For example, light emitted from a light source (e.g., a lamp) of the original reader 4 irradiates and scans the original D placed on the exposure glass 5. The light reflected by the original D is reflected by a plurality of mirrors, travels through a lens, and enters a color sensor that forms an image. The color sensor reads the image into color separation light in red, green, and blue and converts the light into electric signals. An image processor of the original reader 4 performs a plurality of processing including color conversion processing, color correction processing, and spatial frequency correction processing according to the electric signals to create yellow, magenta, cyan, and black image data.

The yellow, magenta, cyan, and black image data is sent to the writer 2. The writer 2 emits laser beams (e.g., exposure light beams) onto the photoconductive drums 11Y, 11M, 11C, and 11K according to the yellow, magenta, cyan, and black image data, respectively.

Each of the four photoconductive drums 11Y, 11M, 11C, and 11K serving as an image bearer rotates counterclockwise in FIG. 1. The chargers 12 disposed opposite the photoconductive drums 11Y, 11M, 11C, and 11K uniformly charge the outer circumferential surface of the photoconductive drums 11Y, 11M, 11C, and 11K, respectively, in a charging process. Thus, a charging potential is produced on each of the photoconductive drums 11Y, 11M, 11C, and 11K. Thereafter, the charged outer circumferential surface of the respective photoconductive drums 11Y, 11M, 11C, and 11K reaches an irradiation position disposed opposite the writer 2 where a laser beam emitted from the writer 2 irradiates each of the photoconductive drums 11Y, 11M, 11C, and 11K.

Four light sources of the writer 2 emit laser beams corresponding to the yellow, magenta, cyan, and black image data onto the photoconductive drums 11Y, 11M, 11C, and 11K through separate optical paths, respectively, in an exposure process.

For example, a laser beam corresponding to the yellow image data irradiates the outer circumferential surface of the leftmost photoconductive drum 11Y. A polygon mirror rotated at high speed directs the laser beam corresponding to the yellow image data to cause the laser beam to scan the photoconductive drum 11Y in an axial direction thereof, that is, a main scanning direction. Thus, an electrostatic latent image corresponding to the yellow image data is formed on the photoconductive drum 11Y charged by the charger 12.

Similarly, a laser beam corresponding to the magenta image data irradiates the outer circumferential surface of the second photoconductive drum 11M from the left in FIG. 1, forming an electrostatic latent image corresponding to the magenta image data. A laser beam corresponding to the cyan image data irradiates the outer circumferential surface of the third photoconductive drum 11C from the left in FIG. 1, forming an electrostatic latent image corresponding to the cyan image data. A laser beam corresponding to the black image data irradiates the outer circumferential surface of the fourth photoconductive drum 11K from the left in FIG. 1, forming an electrostatic latent image corresponding to the black image data.

Thereafter, the outer circumferential surface of the respective photoconductive drums 11Y, 11M, 11C, and 11K bearing the electrostatic latent image reaches a developing position disposed opposite the developing device 13. The developing devices 13 supply yellow, magenta, cyan, and black toners to the photoconductive drums 11Y, 11M, 11C, and 11K, developing the electrostatic latent images formed on the photoconductive drums 11Y, 11M, 11C, and 11K into yellow, magenta, cyan, and black toner images, respectively, in a developing process.

Thereafter, the toner image formed on the respective photoconductive drums 11Y, 11M, 11C, and 11K reaches a primary transfer position disposed opposite the intermediate transfer belt 17. The primary transfer bias rollers 14 disposed opposite the photoconductive drums 11Y, 11M, 11C, and 11K via the intermediate transfer belt 17 contact an inner circumferential surface of the intermediate transfer belt 17 to form four primary transfer nips between the intermediate transfer belt 17 and the photoconductive drums 11Y, 11M, 11C, and 11K, respectively. At the primary transfer nips, the yellow, magenta, cyan, and black toner images formed on the photoconductive drums 11Y, 11M, 11C, and 11K are primarily transferred onto the intermediate transfer belt 17 successively such that the yellow, magenta, cyan, and black toner images are superimposed on the same position on the intermediate transfer belt 17 in a primary transfer process to form a color toner image thereon.

After the primary transfer process, the outer circumferential surface of the respective photoconductive drums 11Y, 11M, 11C, and 11K reaches a cleaning position disposed opposite the cleaner 15. The cleaner 15 collects residual toner failed to be transferred onto the intermediate transfer belt 17 and therefore remaining on the outer circumferential surface of the respective photoconductive drums 11Y, 11M, 11C, and 11K therefrom in a cleaning process.

Thereafter, a discharger discharges the outer circumferential surface of the respective photoconductive drums 11M, 11C, and 11K, finishing a series of image forming processes performed on the photoconductive drums 11Y, 11M, 11C, and 11K.

As the intermediate transfer belt 17 rotates clockwise in FIG. 1, the color toner image formed by the yellow, magenta, cyan, and black toner images superimposed on the intermediate transfer belt 17 reaches a secondary transfer nip formed between the intermediate transfer belt 17 and the secondary transfer bias roller 18. At the secondary transfer nip, the color toner image formed on the intermediate transfer belt 17 is secondarily transferred onto a recording medium in a secondary transfer process.

Thereafter, the outer circumferential surface of the intermediate transfer belt 17 reaches a cleaning position disposed opposite the intermediate transfer belt cleaner 16. The intermediate transfer belt cleaner 16 removes and collects residual toner failed to be transferred onto the recording medium and therefore remaining on the intermediate transfer belt 17 therefrom, finishing a series of transfer processes performed on the intermediate transfer belt 17.

The registration roller pair 9 and the like convey the recording medium conveyed from one of the paper trays 7 to the secondary transfer nip formed between the intermediate transfer belt 17 and the secondary transfer bias roller 18.

For example, one of a plurality of feed rollers 8 picks up and feeds the recording medium from the paper tray 7 loading the plurality of recording media to the registration roller pair 9 through a conveyance guide. The registration roller pair 9 feeds the recording medium to the secondary transfer nip at a time when the color toner image formed on the intermediate transfer belt 17 reaches the secondary transfer nip.

A conveyance belt conveys the recording medium bearing the color toner image to the fixing device 20. The fixing device 20 includes a fixing belt serving as a fixing rotator and a pressure roller serving as a pressure rotator pressed against the fixing belt to form a fixing nip therebetween. As the recording medium bearing the color toner image is conveyed through the fixing nip, the fixing belt and the pressure roller fix the color toner image on the recording medium.

An output roller pair ejects the recording medium bearing the fixed color toner image onto an outside of the image forming apparatus 1, thus finishing a series of image forming processes.

A description is provided of a construction and a control of the fixing device 20 according to a first example embodiment that is incorporated in the image forming apparatus 1 having the construction described above.

Figure 2:
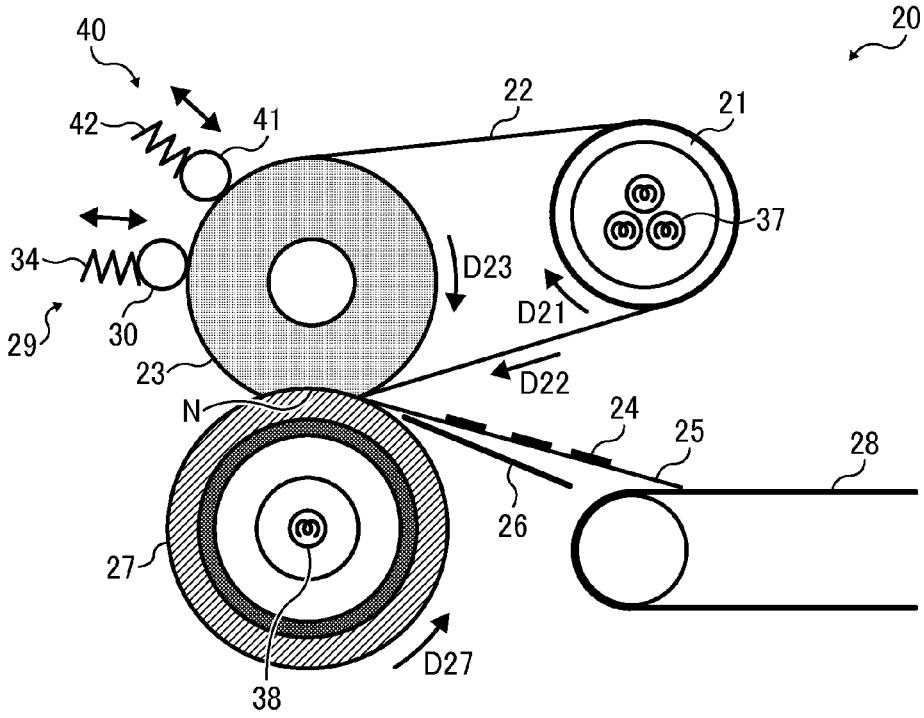
FIG. 2 is a schematic vertical sectional view of a fixing device according to a first example embodiment of the present disclosure that is incorporated in the image forming apparatus shown in FIG. 1.

FIG. 2 is a schematic vertical sectional view of the fixing device 20. As shown in FIG. 2, the fixing device 20 (e.g., a fuser or a fusing unit) includes a fixing belt 22 serving as a fixing rotator or a fixing member; a heater 37 disposed opposite the fixing belt 22 to heat the fixing belt 22; and a pressure roller 27 serving as a pressure rotator or a pressure member pressed against at least a part of the fixing belt 22 to form a fixing nip N therebetween. A conveyance belt 28 conveys a recording medium 25 bearing a toner image 24 transferred from the intermediate transfer belt 17 depicted in FIG. 1 to the fixing device 20. A guide 26 guides the recording medium 25 to the fixing nip N. As the recording medium 25 bearing the unfixed toner image 24 is conveyed through the fixing nip N, the fixing belt 22 and the pressure roller 27 fix the toner image 24 on the recording medium 25 under heat and pressure. The fixing device 20 further includes a surface polishing assembly 40 pressed against the fixing belt 22 to refresh an outer circumferential surface of the fixing belt 22 and an oil application assembly 29 pressed against at least one of the fixing belt 22 and the pressure roller 27 to apply oil to the at least one of the fixing belt 22 and the pressure roller 27.

The surface polishing assembly 40 separably contacts the fixing belt 22 according to a cumulative conveyance time period of the recording medium 25 conveyed through the fixing nip N or a cumulative amount of toner adhered to the recording medium 25.

The oil application assembly 29 separably contacts an oil receiver to be applied with oil, that is, the fixing belt 22 and the pressure roller 27, according to a type and a thickness of the recording medium 25 and the cumulative amount of toner adhered to the recording medium 25 conveyed through the fixing nip N.

A description is provided of a construction of the fixing device 20 in detail.

The fixing device 20 further includes a heating roller 21 and a fixing roller 23 across which the fixing belt 22 is stretched taut. The pressure roller 27 is pressed against the fixing roller 23 via the fixing belt 22 to form the fixing nip N between the fixing belt 22 and the pressure roller 27. The heater 37 serving as a heater or a heat source is disposed inside the heating roller 21. A heater 38 serving as a heater or a heat source is disposed inside the pressure roller 27.

As the recording medium 25 bearing the unfixed toner image 24 is conveyed through the fixing nip N formed between the fixing belt 22 and the pressure roller 27 pressed against the fixing roller 23 via the fixing belt 22, the fixing belt 22 and the pressure roller 27 fix the toner image 24 on the recording medium 25 under heat and pressure. A shaft of each of the heating roller 21, the fixing roller 23, and the pressure roller 27 is rotatably mounted on a frame of the fixing device 20 and extends in a longitudinal direction of the frame of the fixing device 20. A driver that drives and rotates the heating roller 21, the fixing roller 23, and the pressure roller 27 and the like are mounted on and held by the frame of the fixing device 20.

A separation plate disposed opposite the fixing roller 23 via the fixing belt 22 or a separation plate disposed opposite the pressure roller 27 contacts a leading edge of the recording medium 25 as the recording medium 25 is ejected from the fixing nip N, thus separating the recording medium 25 from the fixing belt 22 and the pressure roller 27 and guiding the recording medium 25 to an outside of the fixing device 20. Each of the separation plate serving as a separator disposed opposite the fixing roller 23 via the fixing belt 22 and the separation plate disposed opposite the pressure roller 27 is not limited to a plate. Alternatively, a separation claw may be used as the separator. It is preferable that the separation plate, the separation claw, and the like serving as the separator are isolated from the fixing belt 22 and the pressure roller 27 with a slight interval therebetween to prevent the separation plate, the separation claw, and the like from damaging the fixing belt 22 and the pressure roller 27 and degrading the quality of the toner image 24 fixed on the recording medium 25.

A detailed description is now given of a configuration of the heating roller 21.

The heating roller 21 is a thin tube made of metal, for example, and rotatable in a rotation direction D21. The heater 37 is stationarily disposed inside the tubular heating roller 21.

A detailed description is now given of a configuration of the heater 37.

The heater 37 includes a halogen heater, a carbon heater, or the like, for example. Both lateral ends of the heater 37 in a longitudinal direction thereof parallel to an axial direction of the heating roller 21 are mounted on the frame of the fixing device 20. Alternatively, the heater 37 may be an induction heater (IH) disposed outside the heating roller 21.

A power supply (e.g., an alternating current power supply) located inside the image forming apparatus 1 depicted in FIG. 1 controls the heater 37 to heat the heating roller 21 with radiation heat or light. The heating roller 21 heats the fixing belt 22 which in turn heats the recording medium 25 bearing the unfixed toner image 24 while the recording medium 25 contacts the outer circumferential surface of the fixing belt 22. Output of the heater 37 is controlled based on the temperature of the outer circumferential surface of the fixing belt 22 detected by a temperature sensor (e.g., a thermopile) disposed opposite the outer circumferential surface of the fixing belt 22.

A detailed description is now given of a construction of the fixing belt 22.

The fixing belt 22 is looped over and adhered to the fixing roller 23 and the heating roller 21. The pressure roller 27 is pressed against the fixing roller 23 via the fixing belt 22 to form the fixing nip N between the fixing belt 22 and the pressure roller 27.

The fixing belt 22 is a multi-layer endless belt constructed of a base layer, an elastic layer coating the base layer, and a release layer coating the elastic layer. The base layer, having a layer thickness of about 90 micrometers, is made of polyimide (PI) resin. The elastic layer is made of silicone rubber or the like.

The elastic layer, having a layer thickness of about 350 micrometers, is made of an elastic material such as silicone rubber, fluoro rubber, and silicone rubber foam. The release layer, having a layer thickness of about 20 micrometers, is made of tetrafluoroethylene-perfluoroalkylvinylether copolymer (PFA), polyimide (PI), polyether imide (PEI), polyether sulfide (PES), or the like. The release layer serving as an outer layer of the fixing belt 22 facilitates separation of toner of the toner image 24 from the fixing belt 22.

Alternatively, the fixing belt 22 may be a polyimide belt, that is, an endless film made of heat resistant resin and having a thickness of about 90 micrometers, for example. A surface layer is coated with an offset inhibitor such as PFA.

A detailed description is now given of a construction of the fixing roller 23.

The fixing roller 23, accommodating no heater, is constructed of a rigid core made of metal such as iron and aluminum or the like and a thick elastic layer coating the core and made of silicone rubber or the like.

A detailed description is now given of a construction of the pressure roller 27.

Like the fixing roller 23, the pressure roller 27 is a roller constructed of a cored bar made of SUS 304 stainless steel or the like and an elastic layer coating the cored bar and made of fluoro rubber, silicone rubber, silicone rubber foam, or the like. The heater 38 serving as a heater or a heat source is stationarily disposed inside the tubular pressure roller 27. Alternatively, the heater 38 may not be situated inside the pressure roller 27.

Each of the fixing roller 23 and the pressure roller 27 is a rubber roller disposed opposite each other. As the pressure roller 27 is pressed against the fixing roller 23 radially via the fixing belt 22, the fixing nip N is formed between the pressure roller 27 and the fixing belt 22.

A driver drives and rotates the fixing roller 23 clockwise in FIG. 2 in a rotation direction D23. As the fixing roller 23 rotates in the rotation direction D23, the fixing roller 23 frictionally rotates the fixing belt 22 clockwise in FIG. 2 in a rotation direction D22 and the fixing belt 22 frictionally rotates the pressure roller 27 counterclockwise in FIG. 2 in a rotation direction D27. Thus, the fixing belt 22 and the pressure roller 27 rotate in accordance with rotation of the fixing roller 23 at an identical rotation speed.

The image forming apparatus 1 depicted in FIG. 1 may use specific color toners such as clear toner and white toner in addition to yellow, magenta, cyan, and black toners to add values to the toner image 24 formed on the recording medium 25.

As a first value, the clear toner evens the glossiness of the toner image 24 on the recording medium 25. Without the clear toner, the toner image 24 on the recording medium 25 may suffer from uneven gloss. For example, a blank part on the recording medium 25 not bearing the toner image 24 retains the glossiness of paper serving as the recording medium 25. The glossiness of a solid image formed with an increased amount of toner is different from that of a halftone image formed with a decreased amount of toner constituting halftone dots.

As a second value, the white toner forms a visible white toner image on color paper and a metallic sheet such as a hologram sheet. An image forming apparatus not using the white toner forms a visible white toner image by outlining a white ground part on white paper against a color background formed with visible color toner. However, when the color paper and the metallic sheet such as the hologram sheet that do not have a white background are used, the image forming apparatus cannot form a visible white toner image.

When the image forming apparatus 1 uses the specific color toner (e.g., the clear toner and the white toner), a specific color toner image is superimposed on a full color toner image formed by yellow, magenta, cyan, and black toner images. The fixing device 20 fixes the specific color toner image and the full color toner image on the recording medium 25 simultaneously. However, the recording medium 25 bearing the specific color toner image superimposed on the full color toner image is adhered with an increased amount of toner compared to the recording medium 25 bearing the full color toner image only. Accordingly, an adherent (e.g., wax and an additive such as silica) may be adhered to the fixing belt 22, varying heating of the fixing belt 22 or transferring the adherent from the fixing belt 22 to the subsequent recording medium 25, which may result in formation of a faulty toner image on the recording medium 25.

Additionally, the recording medium 25 adhered with the increased amount of toner may be wound around the fixing belt 22 and may not separate from the fixing belt 22. For example, the recording medium 25 is susceptible to adhesion to the fixing belt 22 if the recording medium 25 is thin paper.

To address those circumstances, the fixing device 20 has a configuration to remove a foreign substance or an adherent (e.g., wax, an additive such as silica, and paper dust) by automatically determining a conveyance distance of the recording media 25 conveyed through the fixing device 20 or a cumulative amount of toner of the toner image 24 on the recording media 25 conveyed through the fixing device 20.

A detailed description is now given of a configuration of the surface polishing assembly 40.

The surface polishing assembly 40 is pressed against the fixing belt 22 to refresh the outer circumferential surface of the fixing belt 22 and therefore retain the condition of the outer circumferential surface of the fixing belt 22. The surface polishing assembly 40 separably contacts the fixing belt 22. The surface polishing assembly 40 polishes, presses against, or softens the outer circumferential surface of the fixing belt 22 or attracts the foreign substance from the outer circumferential surface of the fixing belt 22. For example, the surface polishing assembly 40 includes a polishing roller 41 that slides over the outer circumferential surface of the fixing belt 22 to polish or shave the outer circumferential surface of the fixing belt 22 slightly so as to remove the foreign substance from the outer circumferential surface of the fixing belt 22. The surface polishing assembly 40 further includes a mover 42 abutting or being connected to the polishing roller 41 to bring the polishing roller 41 into contact with and separation from the fixing belt 22. Various mechanisms may be used as the mover 42. For example, the mover 42 includes a cam assembly incorporating a driving motor or a solenoid. The polishing roller 41 is a roller made of metal or resin and transferred with polishing marks directly or a roller sprayed with abrasive grains.

A detailed description is now given of a configuration of the oil application assembly 29.

Figure 4:
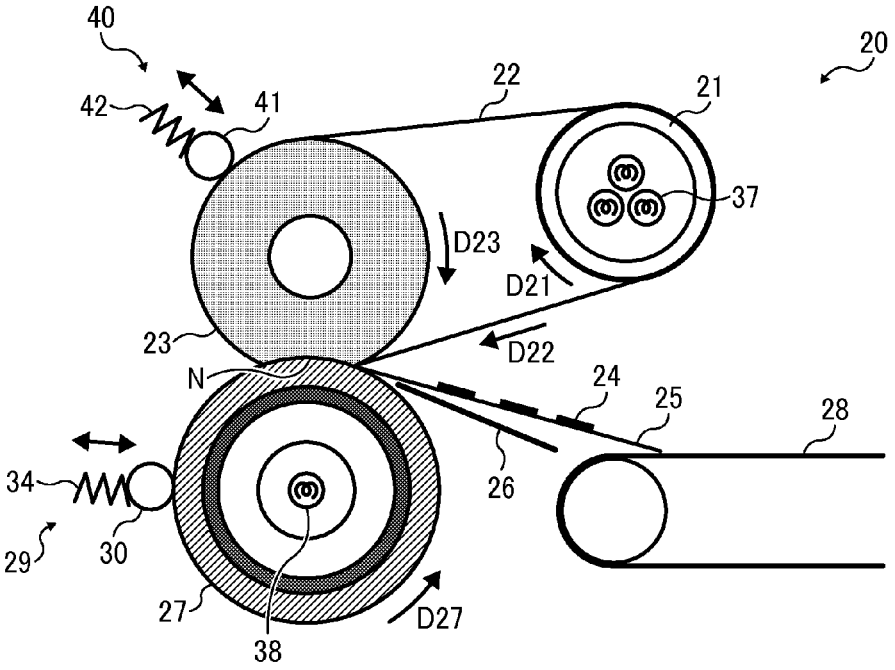
FIG. 4 is a schematic vertical sectional view of the fixing device shown in FIG. 2 illustrating an oil application assembly contacting a pressure roller.

The oil application assembly 29 is pressed against at least one of the fixing belt 22 and the pressure roller 27 to apply oil onto the outer circumferential surface of the at least one of the fixing belt 22 and the pressure roller 27 and therefore facilitate separation of the recording medium 25 from the fixing belt 22 and the pressure roller 27. The oil application assembly 29 separably contacts the fixing belt 22 serving as an oil receiver applied with oil as shown in FIG. 2. Alternatively, the oil application assembly 29 may separably contact the pressure roller 27 serving as an oil receiver applied with oil as shown in FIG. 4.

The oil receiver hereinafter defines at least one of the fixing rotator (e.g., the fixing belt 22) and the pressure rotator (e.g., the pressure roller 27). FIG. 2 illustrates the oil application assembly 29 that contacts the fixing belt 22 to apply oil thereto. Alternatively, the oil application assembly 29 may contact the pressure roller 27 or the like to apply oil thereto as shown in FIG. 4. The oil application assembly 29 includes an oil application roller 30 and a mover 34 abutting or being connected to the oil application roller 30 to bring the oil application roller 30 into contact with and separation from the fixing belt 22.

Various mechanisms may be used as the mover 34. For example, the mover 34 includes a cam assembly incorporating a driving motor or a solenoid. The oil application roller 30 may be an oil impregnation roller made of sponge or the like, an oil application roller incorporating an oil supply channel, or the like.

After the polishing roller 41 polishes the fixing belt 22, separation assistance oil is also removed from the outer circumferential surface of the fixing belt 22 together with the foreign substance and the adherent. Accordingly, after the polishing roller 41 polishes the fixing belt 22, the mover 42 separates the polishing roller 41 from the fixing belt 22 and the mover 34 presses the oil application roller 30 against the oil receiver (e.g., the fixing belt 22) to apply oil thereto, facilitating separation of the recording medium 25 from the oil receiver.

A description is provided of a control to move the surface polishing assembly 40.

Figure 3:
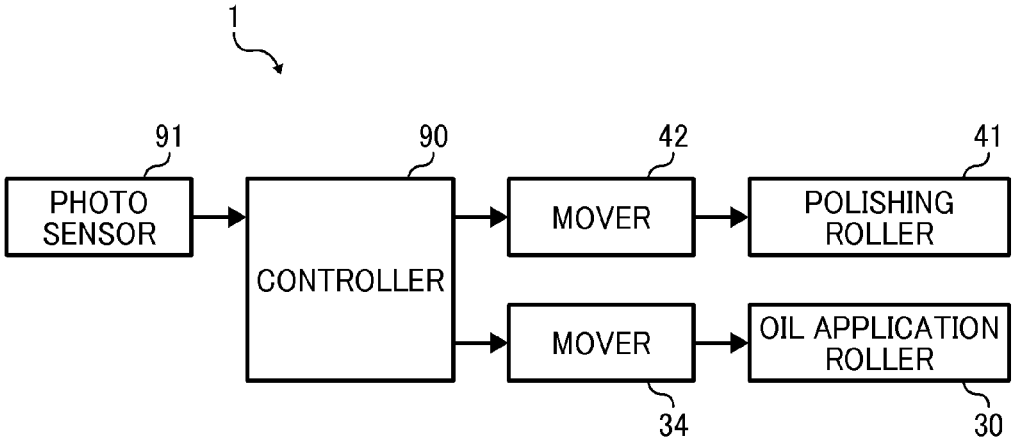
FIG. 3 is a block diagram of the image forming apparatus shown in FIG. 1.

If the polishing roller 41 suffers from clogging, the polishing roller 41 may degrade polishing performance. Further, since the thickness of the surface layer of the fixing belt 22 is limited, it is requested to suppress usage of the polishing roller 41. To address this circumstance, the fixing device 20 includes a controller 90 that counts a conveyance time period when the recording medium 25 is conveyed through the fixing nip N. FIG. 3 is a block diagram of the image forming apparatus 1. As shown in FIG. 3, the controller 90 is operatively connected to the movers 42 and 34. The controller 90 may be located inside the image forming apparatus 1 or the fixing device 20. For example, the controller 90 (e.g., a processor) is a central processing unit (CPU) provided with a random-access memory (RAM) and a read-only memory (ROM). When a cumulative conveyance time period when a plurality of recording media 25 is conveyed through the fixing nip N exceeds a given time period, the controller 90 operatively connected to the mover 42 controls the mover 42 to press the polishing roller 41 against the fixing belt 22, thus refreshing the outer circumferential surface of the fixing belt 22 while suppressing usage of the polishing roller 41 and thereby preventing formation of a faulty toner image on the recording medium 25.

The adherent adhered to the fixing belt 22 includes an additive such as wax and silica contained in toner of the toner image 24 on the recording medium 25. To address this circumstance, the controller 90 determines a toner density of toner of the toner image 24 on the recording medium 25 and a toner adhesion area rate of an area of the toner image 24 relative to an area of the recording medium 25. If a cumulative amount of toner of the toner image 24 on the recording media 25 conveyed through the fixing nip N exceeds a given value, the controller 90 controls the mover 42 to press the polishing roller 41 against the fixing belt 22, refreshing or refining the outer circumferential surface of the fixing belt 22 while suppressing usage of the polishing roller 41 and therefore preventing formation of a faulty toner image.

FIG. 2 illustrates the oil application assembly 29 contacting the fixing belt 22. Alternatively, the oil application assembly 29 may contact the pressure roller 27 as shown in FIG. 4. FIG. 4 is a schematic vertical sectional view of the fixing device 20 illustrating the oil application assembly 29 contacting the pressure roller 27.

Figure 5:
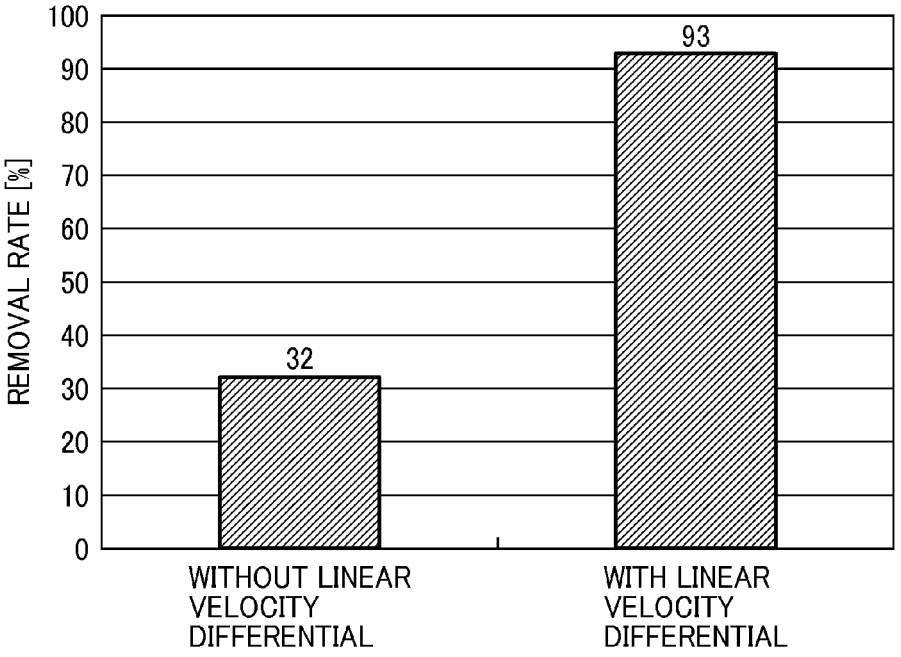
FIG. 5 is a graph showing a removal rate of wax adhered to a fixing belt incorporated in the fixing device shown in FIG. 2.

In order to enhance removal of the foreign substance and the adherent from the fixing belt 22, the fixing belt 22 and the polishing roller 41 rotate at different linear velocities, respectively, as described below. FIG. 5 is a graph showing a removal rate of wax adhered to the fixing belt 22 therefrom with and without difference in linear velocity between the fixing belt 22 and the polishing roller 41 when the polishing roller 41 polishes the fixing belt 22.

The removal rate of wax is obtained by adhering an identical amount of wax to the fixing belt 22, measuring a weight of the fixing belt 22 before and after the polishing roller 41 polishes the fixing belt 22, and performing calculation based on a formula (1) below.

$$R=(Wb-Wa)/(Wb-Wf)\times 100 \quad (1)$$

In the formula (1), R represents the removal rate of wax in percent. Wb represents a weight of the fixing belt 22 in gram before refreshing. Wa represents a weight of the fixing belt 22 in gram after refreshing. Wf represents a weight of the fixing belt 22 in gram when the fixing belt 22 is adhered with no wax.

FIG. 5 shows that the removal rate of wax when the fixing belt 22 and the polishing roller 41 rotate at different linear velocities, respectively, is greater than that when the fixing belt 22 and the polishing roller 41 rotate at an identical linear velocity by about three times. That is, when the fixing belt 22 and the polishing roller 41 rotate at different linear velocities, respectively, the polishing roller 41 removes wax from the fixing belt 22 effectively. According to this example embodiment, one of the fixing belt 22 and the polishing roller 41 rotates at a linear velocity higher than that of another one of the fixing belt 22 and the polishing roller 41 by a range of from about three times to about six times. Alternatively, the fixing belt 22 and the polishing roller 41 may rotate at other linear velocity differentials according to a fixing system.

A description is provided of a control to move the surface polishing assembly 40.

Since the oil application roller 30 such as an oil impregnation roller has limitation in an amount of oil impregnated therein, it is requested to suppress usage of the oil application roller 30. To address this request, when a thick recording medium 25 having an increased thickness that separates from the fixing belt 22 readily without assistance and therefore does not necessitate oil application to the fixing belt 22 is conveyed through the fixing nip N, the controller 90 controls the mover 34 to separate the oil application roller 30 from the fixing belt 22. Conversely, when a thin recording medium 25 having a decreased thickness that des not separate from the fixing belt 22 without assistance and therefore necessitates oil application to the fixing belt 2 is conveyed through the fixing nip N, the controller 90 controls the mover 34 to bring the oil application roller 30 into contact with the fixing belt 22. Thus, the oil application roller 30 enhances separation of the recording medium 25 from the fixing belt 22 while suppressing usage of oil.

The type of oil applied to the oil receiver (e.g., the fixing belt 22 and the pressure roller 27) is not limited. For example, various agents used as a lubricant may be employed. The fixing device 20 may incorporate the single oil application assembly 29 or a plurality of oil application assemblies 29.

The controller 90 controls the mover 34 to bring the oil application roller 30 into contact with and separation from the fixing belt 22 according to the thickness of the recording medium 25 that is defined variably. For example, if the recording medium 25 is a thin sheet, the controller 90 controls the mover 34 to press the oil application roller 30 against the oil receiver. The thickness of the thin sheet is defined variably. For example, the thin sheet that causes oil application to the oil receiver defines a sheet having a paper weight not greater than 105 gsm.

The controller 90 controls motion of the oil application roller 30 relative to the oil receiver according to whether or not the recording medium 25 bears the specific color toner, that is, at least one of the clear toner and the white toner. If the recording medium 25 bears the specific color toner, the specific color toner on the recording medium 25 may degrade separation of the recording medium 25 from the fixing belt 22. To address this circumstance, when the recording medium 25 bears the specific color toner, the controller 90 controls the mover 34 to press the oil application roller 30 against the oil receiver. Thus, the oil application roller 30 applies oil to the fixing belt 22, enhancing separation of the recording medium 25 susceptible to adhesion to the fixing belt 22 from the fixing belt 22.

The controller 90 controls the mover 34 to press the oil application roller 30 against the fixing belt 22 according to the type of the recording medium 25 conveyed through the fixing nip N. Separation of the recording medium 25 from the fixing belt 22 varies depending on the type of the recording medium 25. For example, the recording medium 25 of particular types may not separate from the fixing belt 22 readily. To address this circumstance, when the recording medium 25 of the particular types is conveyed through the fixing nip N, the controller 90 controls the mover 34 to bring the oil application roller 30 into contact with the fixing belt 22 to apply oil thereto, facilitating separation of the recording medium 25 from the fixing belt 22.

The type of the recording medium 25 that causes application of oil to the oil receiver is defined variably. For example, the controller 90 determines whether or not to apply oil to the oil receiver based on the type of the recording medium 25, that is, non-coated paper or coated paper. If the recording medium 25 is non-coated paper that does not separate from the oil receiver readily, the controller 90 controls the mover 34 to bring the oil application roller 30 into contact with the oil receiver. Conversely, if the recording medium 25 is coated paper that separates from the oil receiver readily, the controller 90 controls the mover 34 to separate the oil application roller 30 from the oil receiver.

The fixing device 20 may include a recording medium detector that detects the thickness and the type of the recording medium 25, whether or not the recording medium 25 bears the specific color toner, and the like. Various mechanisms may be used as the recording medium detector. For example, as shown in FIG. 3, a photo sensor 91 serves as the recording medium detector. The photo sensor 91 detects an amount of light transmitted through the recording medium 25 based on which the controller 90 determines the thickness and the like of the recording medium 25.

As shown in FIGS. 2 and 4, the surface polishing assembly 40 and the oil application assembly 29 are installed in the fixing device 20 that employs a belt fixing method in which the fixing belt 22 and the pressure roller 27 form the fixing nip N. Alternatively, the surface polishing assembly 40 and the oil application assembly 29 may be installed in a fixing device that employs a roller fixing method in which a pressure roller is pressed against a fixing roller to form a fixing nip therebetween, a fixing device that employs a film fixing method in which a fixing film, instead of the fixing belt 22, is stretched taut across a fixing roller and a heating roller, or fixing devices that employ other fixing methods.

A description is provided of a series of control processes to control the polishing roller 41 and the oil application roller 30 to polish the fixing belt 22.

Figure 6:
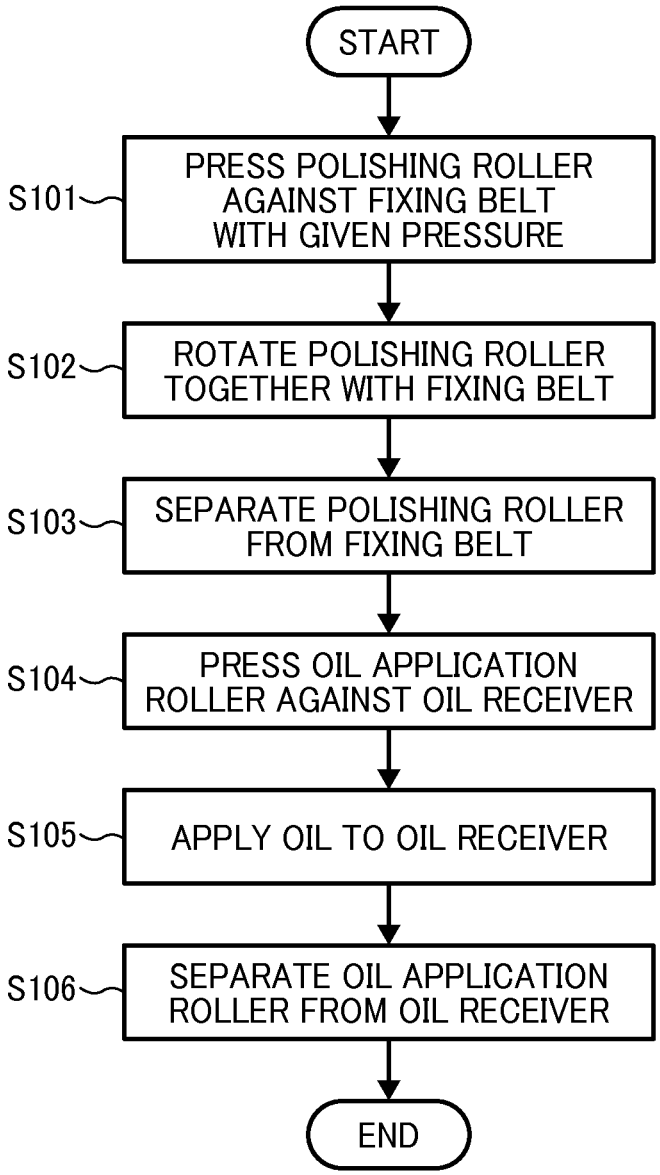
FIG. 6 is a flowchart showing control processes performed by the fixing device shown in FIG. 2.

FIG. 6 is a flowchart showing the control processes. In step S101, the mover 42 presses the polishing roller 41 against the fixing belt 22 with given pressure. In step S102, the polishing roller 41 rotates together with the fixing belt 22 in accordance with rotation of the fixing belt 22 for a given time period to polish the outer circumferential surface of the fixing belt 22, removing wax adhered to the fixing belt 22 therefrom. In step S103, the mover 42 separates the polishing roller 41 from the fixing belt 22. In step S104, the mover 34 presses the oil application roller 30 against the oil receiver, that is, the fixing belt 22 rotating in the rotation direction D22 in FIG. 2 and the pressure roller 27 rotating in the rotation direction D27 in FIG. 4. In step S105, the oil application roller 30 applies oil that facilitates separation of the recording medium 25 from the oil receiver to the oil receiver for a given time period. In step S106, the mover 34 separates the oil application roller 30 from the oil receiver.

A description is provided of a construction of a fixing device 20S according to a second example embodiment.

It is to be noted that the construction and the configuration of the fixing device 20S that are identical to those of the fixing device 20 according to the first example embodiment described above are omitted.

Figure 7:
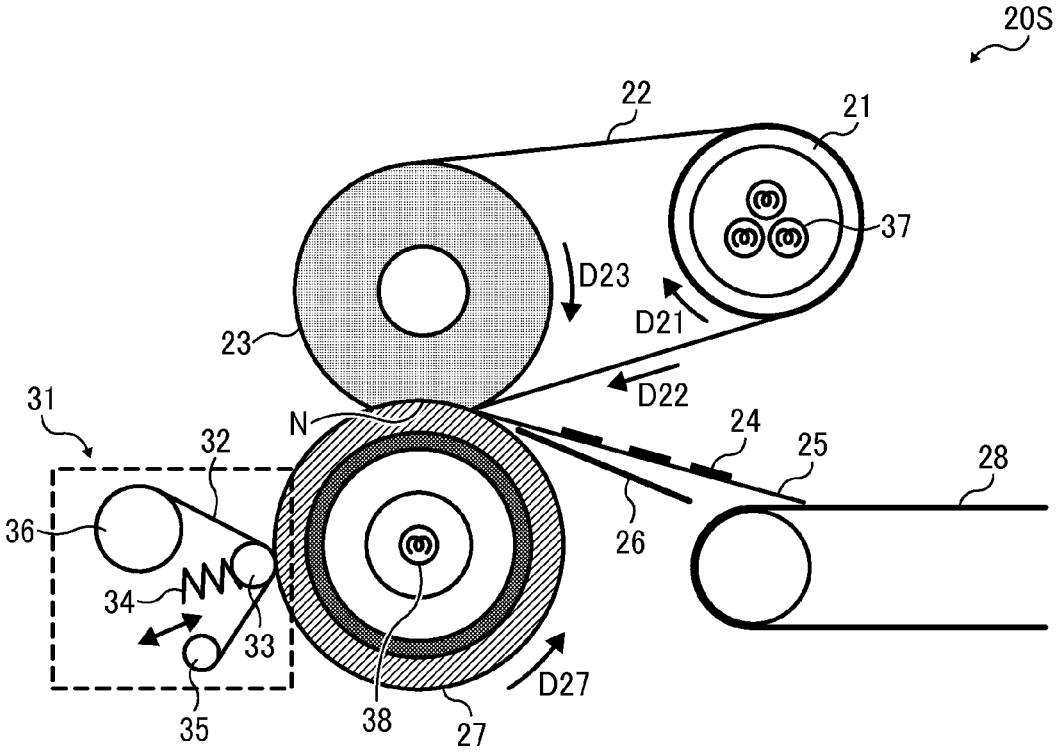
FIG. 7 is a schematic vertical sectional view of a fixing device according to a second example embodiment of the present disclosure.

FIG. 7 is a schematic vertical sectional view of the fixing device 20S. As shown in FIG. 7, the fixing device 20S includes a cleaning web unit 31 instead of the oil application assembly 29 depicted in FIGS. 2 and 4. The cleaning web unit 31 includes a cleaning web 32 serving as a cleaner and a pressurization roller 33 serving as a presser that presses the cleaning web 32 against the pressure roller 27. The cleaning web unit 31 separably contacts the pressure roller 27. For example, the mover 34 abutting or being connected to the pressurization roller 33 causes the pressurization roller 33 to press the cleaning web 32 against the pressure roller 27.

According to this example embodiment, the cleaning web unit 31 separably contacts the pressure roller 27. Alternatively, the cleaning web unit 31 may separably contact the fixing belt 22 and the fixing roller 23.

If the fixing belt 22, the fixing roller 23, and the pressure roller 27 are adhered with toner or the like, the fixing belt 22, the fixing roller 23, and the pressure roller 27 may be stained with toner or the like that may in turn damage the toner image 24 on the recording medium 25 and degrade separation of the recording medium 25 from the fixing belt 22. To address this circumstance, the fixing device 20S incorporates the cleaning web unit 31 that cleans the pressure roller 27. The cleaning web unit 31 includes the cleaning web 32 that cleans the pressure roller 27. As a cleaning web supply roller 35 supplies the cleaning web 32 gradually and a cleaning web reel roller 36 reels up the cleaning web 32, the fresh cleaning web 32 contacts the pressure roller 27 constantly to clean the pressure roller 27.

In addition to cleaning, the cleaning web unit 31 conducts oil application, thus serving as an oil application assembly that applies oil to the pressure roller 27 to facilitate separation of the recording medium 25 from the pressure roller 27 and the fixing belt 22 while removing offset toner from the fixing belt 22 and the pressure roller 27.

The cleaning web 32 is a long sheet. The long sheet type cleaning web 32 is impregnated with an increased amount of oil compared to the oil application roller 30 depicted in FIGS. 2 and 4, increasing a maintenance cycle and a life of the cleaning web unit 31.

With reference to Table 1 below, a description is provided of a control example to move the oil application assembly (e.g., the oil application assembly 29 depicted in FIGS. 2 and 4 and the cleaning web unit 31 depicted in FIG. 7).

TABLE 1

| Contact and separation of the oil application assembly to and from the oil receiver | | | |
|---|---|---|---|
| Paper type | | Full color toner | Specific color toner |
| Non-coated paper | Thin paper | Contact | Contact |
| | Thick paper | Contact | Contact |
| Coated paper | Thin paper | Contact | Contact |
| | Thick paper | Separate | Separate |

In Table 1, "Specific color toner" denotes that the recording medium 25 bears the specific color toner regardless of whether or not the recording medium 25 bears yellow, magenta, cyan, and black toners constituting a full color toner image. "Thin paper" denotes a sheet having a thickness defined by a paper weight not greater than 105 gsm. "Thick paper" denotes a sheet having a thickness defined by a paper weight greater than 105 gsm. "Coated paper" denotes a sheet coated with a white pigment and having an increased surface smoothness.

"Contact" denotes that the oil application assembly contacts the oil receiver. "Separate" denotes that the oil application assembly separates from the oil receiver. The oil receiver defines at least one of the fixing rotator (e.g., the fixing belt 22) and the pressure rotator (e.g., the pressure roller 27).

According to the control example shown in Table 1, the controller 90 controls contact and separation of the oil application assembly with respect to the oil receiver based on the thickness of the recording medium 25 and usage of the specific color toner, that is, whether or not the recording medium 25 bears the specific color toner. Additionally, the controller 90 controls contact and separation of the oil application assembly based on the type of the recording medium 25, that is, coated paper or non-coated paper. Thus, the oil application assembly prevents the recording medium 25 from being wound around the fixing belt 22 and the pressure roller 27 and being jammed between the fixing belt 22 and the pressure roller 27.

The image forming apparatus 1 shown in FIG. 1 incorporates the fixing device 20 depicted in FIGS. 2 and 4 or the fixing device 20S depicted in FIG. 7. The fixing devices 20 and 20S prevent the foreign substance and the adherent on the fixing belt 22 from moving to the recording medium 25 so as to prevent formation of a faulty toner image on the recording medium 25 and enhance separation of the recording medium 25 from the fixing belt 22. Hence, the image forming apparatus 1 incorporating the fixing device 20 or 20S attains an improved reliability.

A description is provided of operations and advantages of the fixing devices 20 and 20S.

The controller 90 depicted in FIG. 3 adjusts a contact condition under which the oil application assembly (e.g., the oil application assembly 29 depicted in FIGS. 2 and 4 and the cleaning web unit 31 depicted in FIG. 7) presses against the oil receiver (e.g., the fixing belt 22 and the pressure roller 27 depicted in FIGS. 2, 4, and 7) according to a contact condition under which the surface polishing assembly (e.g., the surface polishing assembly 40 depicted in FIGS. 2 and 4) presses against the fixing rotator (e.g., the fixing belt 22). Accordingly, the surface polishing assembly and the oil application assembly prevent the foreign substance and the adherent on the fixing rotator from moving to the recording medium 25 so as to prevent formation of a faulty toner image on the recording medium 25 and enhance separation of the recording medium 25 from the fixing rotator.

The surface polishing assembly removes the foreign substance and the adherent from the fixing rotator. Thereafter, the oil application assembly presses against the fixing rotator. Accordingly, the surface polishing assembly and the oil application assembly prevent the foreign substance and the adherent on the fixing rotator from moving to the recording medium 25 so as to prevent formation of a faulty toner image on the recording medium 25 and enhance separation of the recording medium 25 from the fixing rotator.

The controller 90 counts the conveyance time period for which the recording medium 25 is conveyed through the fixing nip N. When the cumulative conveyance time period exceeds the given time period, the surface polishing assembly refreshes the fixing rotator automatically. Accordingly, the surface polishing assembly prevents the foreign substance and the adherent on the fixing rotator from moving to the recording medium 25 so as to prevent formation of a faulty toner image on the recording medium 25.

The controller 90 determines the cumulative amount of toner of the toner image 24 on the recording media 25 conveyed through the fixing device 20 or 20S based on the toner density of toner of the toner image 24 on the recording medium 25 and the toner adhesion area rate of the area of the toner image 24 relative to the area of the recording medium 25. If the cumulative amount of toner exceeds the given value, the controller 90 controls the mover 42 to press the polishing roller 41 against the fixing rotator, refreshing or refining the outer circumferential surface of the fixing rotator automatically. Accordingly, the surface polishing assembly prevents the foreign substance and the adherent on the fixing rotator from moving to the recording medium 25 so as to prevent formation of a faulty toner image on the recording medium 25.

The surface polishing assembly in contact with the fixing rotator rotates at a linear velocity different from a linear velocity of the fixing rotator. Accordingly, the surface polishing assembly removes the foreign substance and the adherent from the fixing rotator with an improved performance.

The controller 90 determines the cumulative amount of toner of the toner image 24 on the recording media 25 conveyed through the fixing device 20 or 20S based on the toner density of toner of the toner image 24 on the recording medium 25 and the toner adhesion area rate of the area of the toner image 24 relative to the area of the recording medium 25. If the cumulative amount of toner of the toner image 24 on the recording media 25 exceeds the given value, the controller 90 controls the mover 34 to press the oil applicator (e.g., the oil application roller 30 and the cleaning web 32) against the fixing rotator. Accordingly, oil applied to the fixing rotator by the oil applicator facilitates separation of the recording medium 25 from the fixing rotator even if the recording medium 25 is adhered with an increased amount of toner.

As shown in FIG. 7, the cleaner (e.g., the cleaning web 32) configured to supply oil to the fixing rotator applies oil to the fixing rotator. Accordingly, the cleaner facilitates separation of the recording medium 25 from the fixing rotator.

The cleaning web 32 serving as the cleaner is a long sheet that increases the life of the cleaner. The long sheet of the cleaning web 32 impregnated with oil facilitates separation of the recording medium 25 from the fixing rotator.

As shown in FIGS. 2, 4, and 7, the controller 90 controls the mover 34 to press the oil applicator (e.g., the oil application roller 30 and the cleaning web 32) against the oil receiver (e.g., the fixing belt 22 and the pressure roller 27) when the recording medium 25 conveyed through the fixing nip N is a type of paper that does not separate from the oil receiver readily, thus facilitating separation of the recording medium 25 from the oil receiver.

The construction and the configuration of the fixing devices 20 and 20S may be combined to achieve advantages by synergism. The fixing devices 20 and 20S prevent adhesion of the foreign substance to the fixing rotator over time and resultant failure. Additionally, the fixing devices 20 and 20S prevent the recording medium 25 from being wound around the fixing rotator and being jammed between the fixing rotator and the pressure rotator without degrading productivity of the fixing devices 20 and 20S.

As shown in FIGS. 2, 4, and 7, the fixing devices 20 and 20S include a fixing rotator (e.g., the fixing belt 22) and a pressure rotator (e.g., the pressure roller 27) pressed against the fixing rotator to form the fixing nip N therebetween. As the recording medium 25 bearing the toner image 24 is conveyed through the fixing nip N, the fixing rotator and the pressure rotator fix the toner image 24 on the recording medium 25 under heat and pressure. An oil applicator (e.g., the oil application roller 30 depicted in FIGS. 2 and 4 and the cleaning web 32 depicted in FIG. 7) impregnated with a slight amount of oil presses against at least one of the fixing rotator and the pressure rotator. A first mover (e.g., the mover 34) connected to the oil applicator separably brings the oil applicator into contact with the fixing rotator or the pressure rotator. A surface polisher (e.g., the polishing roller 41) refines or refreshes an outer circumferential surface of the fixing rotator. A second mover (e.g., the mover 42) connected to the surface polisher separably brings the surface polisher into contact with the fixing rotator. A controller (e.g., the controller 90 depicted in FIG. 3) operatively connected to the first mover and the second mover controls the first mover to bring the oil applicator into contact with the fixing rotator or the pressure rotator according to a contact condition under which the surface polisher contacts the fixing rotator.

Accordingly, the fixing devices 20 and 20S prevent adhesion of the foreign substance to the fixing rotator over time and resultant failure such as variation in gloss of the toner image 24 on the recording medium 25. Additionally, the fixing devices 20 and 20S prevent the recording medium 25 from being wound around the fixing rotator and being jammed between the fixing rotator and the pressure rotator without degrading productivity of the fixing devices 20 and 20S.

According to the example embodiments described above, the fixing belt 22 serves as a fixing rotator. Alternatively, a fixing film, a fixing sleeve, a fixing roller, or the like may be used as a fixing rotator. Further, the pressure roller 27 serves as a pressure rotator. Alternatively, a pressure belt or the like may be used as a pressure rotator.

The present disclosure has been described above with reference to specific example embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative example embodiments may be combined with each other and/or substituted for each other within the scope of the present disclosure.

What is claimed is:

1. A fixing device comprising:

a fixing rotator rotatable in a given direction of rotation;

a pressure rotator pressed against the fixing rotator to form a fixing nip therebetween, through which a recording medium bearing a toner image is conveyed;

an oil applicator impregnated with oil to be applied to at least one of the fixing rotator and the pressure rotator;

a first mover connected to the oil applicator to separably bring the oil applicator into contact with the at least one of the fixing rotator and the pressure rotator;

a surface polisher to refresh an outer circumferential surface of the fixing rotator;

a second mover connected to the surface polisher to separably bring the surface polisher into contact with the fixing rotator; and a controller operatively connected to the first mover and the second mover to control the first mover to bring the oil applicator into contact with the at least one of the fixing rotator and the pressure rotator according to a contact condition under which the surface polisher contacts the fixing rotator.

2. The fixing device according to claim 1, wherein the first mover brings the oil applicator into contact with the at least one of the fixing rotator and the pressure rotator after the second mover separates the surface polisher from the fixing rotator.

3. The fixing device according to claim 1, wherein the surface polisher includes a polishing roller to contact the fixing rotator to rotate in accordance with rotation of the fixing rotator.

4. The fixing device according to claim 3, wherein the controller counts a cumulative conveyance time period of the recording medium conveyed through the fixing nip, and wherein the second mover brings the polishing roller into contact with the fixing rotator when the cumulative conveyance time period exceeds a given time period.

5. The fixing device according to claim 3, wherein the controller determines a cumulative amount of toner of the toner image on the recording medium conveyed through the fixing nip based on a toner density of the toner image on the recording medium and a toner adhesion area rate of an area of the toner image relative to an area of the recording medium, and wherein the second mover brings the polishing roller into contact with the fixing rotator when the cumulative amount of toner exceeds a given value.

6. The fixing device according to claim 3, wherein the polishing roller rotates at a first linear velocity different from a second linear velocity of the fixing rotator.

7. The fixing device according to claim 1, wherein the first mover brings the oil applicator into contact with the at least one of the fixing rotator and the pressure rotator according to a type of the recording medium.

8. The fixing device according to claim 1, wherein the controller determines a cumulative amount of toner of the toner image on the recording medium conveyed through the fixing nip based on a toner density of the toner image on the recording medium and a toner adhesion area rate of an area of the toner image relative to an area of the recording medium, and wherein the first mover brings the oil applicator into contact with the at least one of the fixing rotator and the pressure rotator while the recording medium is conveyed through the fixing nip when the cumulative amount of toner exceeds a given value.

9. The fixing device according to claim 1, wherein the oil applicator includes a cleaner to clean the at least one of the fixing rotator and the pressure rotator.

10. The fixing device according to claim 9, further comprising a presser to press the cleaner against the at least one of the fixing rotator and the pressure rotator.

11. The fixing device according to claim 10, wherein the first mover is connected to the presser to cause the presser to separably press the cleaner against the at least one of the fixing rotator and the pressure rotator.

12. The fixing device according to claim 10, wherein the presser includes a pressurization roller.

13. The fixing device according to claim 9, wherein the cleaner includes a sheet type cleaning web.

14. The fixing device according to claim 1, wherein the oil applicator includes an oil application roller to contact the at least one of the fixing rotator and the pressure rotator to rotate in accordance with rotation of the at least one of the fixing rotator and the pressure rotator.

15. The fixing device according to claim 1, wherein the fixing rotator includes a fixing belt.

16. The fixing device according to claim 1, wherein the pressure rotator includes a pressure roller.

17. An image forming apparatus comprising:

an image bearer to bear a toner image; and a fixing device, disposed downstream from the image bearer in a recording medium conveyance direction, to fix the toner image on a recording medium, the fixing device including:

a fixing rotator rotatable in a given direction of rotation;

a pressure rotator pressed against the fixing rotator to form a fixing nip therebetween, through which the recording medium bearing the toner image is conveyed;

an oil applicator impregnated with oil to be applied to at least one of the fixing rotator and the pressure rotator;

a first mover connected to the oil applicator to separably bring the oil applicator into contact with the at least one of the fixing rotator and the pressure rotator;

a surface polisher to refresh an outer circumferential surface of the fixing rotator;

a second mover connected to the surface polisher to separably bring the surface polisher into contact with the fixing rotator; and a controller operatively connected to the first mover and the second mover to control the first mover to bring the oil applicator into contact with the at least one of the fixing rotator and the pressure rotator according to a contact condition under which the surface polisher contacts the fixing rotator.

* * * * *